US005155087A

United States Patent [19]

Matsushita et al.

[11] Patent Number: 5,155,087

[45] Date of Patent: Oct. 13, 1992

[54] RECORDING MATERIAL

[75] Inventors: Toshihiko Matsushita; Shigetoshi Hiraishi, both of Tokyo; Sadao Morishita, Ushiku, all of Japan

[73] Assignee: Mitsubishi Paper Mills, Ltd., Tokyo, Japan

[21] Appl. No.: 704,920

[22] Filed: May 22, 1991

Related U.S. Application Data

[63] Continuation of Ser. No. 109,180, Oct. 16, 1987, abandoned.

[30] Foreign Application Priority Data

Oct. 17, 1986 [JP] Japan ..... 61-246899
Mar. 12, 1987 [JP] Japan ..... 62-57830

[51] Int. Cl.[5] ..... B41M 5/145; B41M 5/15; B41M 5/155; B41M 5/30

[52] U.S. Cl. ..... 503/217; 430/200; 503/216; 503/218; 503/221; 503/223; 503/224; 503/226

[58] Field of Search ..... 427/150-152; 503/216-218, 225, 210-212, 221, 223, 224, 226; 430/200

[56] References Cited

U.S. PATENT DOCUMENTS 4,439,512 3/1984 Ceintry ..... 503/225
4,521,793 6/1985 Kabashima et al. ..... 503/225

FOREIGN PATENT DOCUMENTS 59-135186 8/1984 Japan ..... 507/217
0210491 10/1985 Japan ..... 503/225
60-262686 12/1985 Japan ..... 503/217

OTHER PUBLICATIONS

Chemical Abstract (106:41694e).

*Primary Examiner*—B. Hamilton Hess
*Attorney, Agent, or Firm*—Cushman, Darby & Cushman

[57] ABSTRACT

A recording material containing as a color forming system (a) a colorless or light-colored dye precursor, and (b) an isocyanate compound having aromaticity, and if necessary (c) a color developer is excellent in image retention rates in terms of light resistance and plasticizer resistance and has a large degree of freedom of hues.

18 Claims, No Drawings

RECORDING MATERIAL

This is a continuation of application Ser. No. 07/109,180, filed on Oct. 16, 1987, now abandoned.

BACKGROUND OF THE INVENTION

This invention relates to a recording material containing a special color forming system excellent in image storability.

Heretofore, a number of chemical color forming systems using recording energy such as heat, pressure, light, electric current, etc. have been known. Among them, a color forming system of two components, that is, an ordinary colorless or light-colored dye precursor and a color developer which forms a color in contact with the dye precursor, has long been known and widely used in recording materials. For example, there are used heat-sensitive recording materials using heat energy, pressure-sensitive recording materials using pressure energy, light-sensitive recording materials using light energy and electrical current-passing heat-sensitive recording materials using electrical energy. Among them, the pressure-sensitive recording materials are most generally used due to the use of plain paper.

In general, the pressure-sensitive recording materials are prepared by forming an emulsion of a dye precursor using a suitable solvent in several microns, microcapsulizing the emulsion, coating the resulting microcapsules on a support to form a top sheet, and preparing a bottom sheet by coating a color developer on a support. Image recording can be obtained by facing the microcapsul coated plane and the color developer coated plane oppositely, applying a writing or hitting pressure thereon to rupture microcapsuls and to release the contents including the dye precursor, and contacting the contents with a color developer in the color developer layer to bring about a color forming reaction.

On the other hand, heat-sensitive materials are widely used recently. Since the heat-sensitive recording method using a thermal head has many advantages in that no noise takes place at the time of recording due to non-impact, development and fixing are not necessary, maintenance of apparatus is easy, and the like, it is widely used in outputs of computers, printers for table-type computers, recorders for medical measuring apparatus, low-speed and high-speed facsimile machines, automatic ticket vending machines, heat-sensitive copying machines, etc.

Heat-sensitive recording materials generally comprises a support and formed thereon a heat-sensitive layer comprising a finely ground dye precursor, a finely ground color developer and the like, and a binder. By heating with a thermal head, a thermal pen, laser, etc., the color developer and the dye precursor are melted and contacted to bring about a color forming reaction for obtaining image recording.

As the dye precursor, electron-donating compounds are used, and as the color developer, electron-accepting compounds are used, in general. This is because the dye precursor which is an electron-donating compound is highly reactive and instantly gives a colored image with a high density when contacted with the dye precursor which is an electron-accepting compound. There are other advantages in that there can be obtained an appearance near a white color, there can be obtained various kinds of developed hues such as a red color, an orange color, a yellow color, a green color, a blue color, a black color, etc. But there are disadvantages in that the obtained image is low in light resistance and weather resistance, the obtained image is inferior in storability of recording, e.g., it is easily discolored when exposed to light such as sunbeams. Due to such disadvantages, the utility of heat-sensitive recording materials is limited to some extent. Improvement of the heat-sensitive recording materials is strongly desired.

In order to improve the above-mentioned disadvantages, U.S. Pat. No. 4,521,793 discloses a recording material comprising a color forming agent system comprising an isocyanate compound having aromaticity formed on the same substrate or different substrates. This color forming agent system forms a carboxamide series azomethine colored product by the catalytic reaction of the two components. The colored product is excellent in chemical resistance and light resistance. The hue of the colored product can widely be changed by properly selecting the imino compounds and isocyanate compounds to be used. Most obtained colors are red, orange and yellow. For example, as to a black color which is required in many cases for recording, there is mostly obtained black tinted with red. It is relatively difficult to obtain a black color tinted with blue.

In order to improve the disadvantages of U.S. Pat. No. 4,521,793, Japanese Patent Unexamined Publication No. 59-135186 discloses a recording sheet comprising a support and formed thereon a color forming layer comprising (i) a known color forming agent system of a well-known leuco dye and an acidic substance and (ii) a color forming agent system of the imino compound and the isocyanate compound mentioned above, said recording sheet satisfying the storage stability of recording and the degree of freedom of hues which are developable. But said recording sheet is still insufficient in selecting proper hues and image storability such as plasticizer resistance.

SUMMARY OF THE INVENTION

It is an object of this invention to provide a recording material excellent in image storability by using a color forming system different from known color forming systems.

This invention provides a recording material comprising a two-component color forming system comprising (a) a colorless or light-colored dye precursor and (b) an isocyanate compound having aromaticity, said color forming system being carried on a substrate or at least two different substrates.

This invention also provides a recording material comprising a three-component color forming system comprising (a) a colorless or light-colored dye precursor, (b) an isocyanate compound having aromaticity, and (c) a color developer which can form a color by contacting with the dye precursor, said color forming system being carried on a substrate or at least two different substrates.

DESCRIPTION OF THE PREFERRED EMBODIMENTS

The color forming system used in this invention fundamentally comprises (a) a colorless or light-colored dye precursor and (b) an isocyanate compound having aromaticity. It is a very surprising thing that a color forming system compring (b) an isocyanate compound having aromaticity which is one component of the color forming system of U.S. Pat. No. 4,521,793, and (a) a colorless or light-colored dye precursor which is also one component in a known color forming system disclosed in Japanese Patent Unexamined Publication No. 59-135186, can form a color which is excellent in image storability such as light resistance, plasticizer resistance, etc.

When the dye precursor (a) contacts with the isocyanate compound having aromaticity (b) via outer energy such as heat, a colored reaction product is formed by the reaction of the two components. Since this reaction is irreversible, the obtained reaction product cannot be changed to the colorless or light-colored dye precursor again. As a result, the obtained colored reaction product constitutes an image excellent in image storability. According to prior art, since the reaction between the dye precursor and a conventional color developer is a reversible color forming reaction, the resulting image is inferior in image storability such as light resistance, plasticizer resistance, etc. But, according to this invention, since the dye precursor is reacted with a reactant which can bring about an irreversible reaction, that is, the isocyanate compound having aromaticity, the image storability is unexpectedly improved. Further, the color forming system used in this invention is also improved in the degree of freedom for hues, that is, desired hues can be obtained freely by properly selecting dye precursors from a wide range of various dye precursors. This is also improved compared with U.S. Pat. No. 4,521,793. Particularly, the formation of a black color is effective in this invention.

The isocyanate compound having aromaticity (b) includes colorless or pale color aromatic isocyanates and heterocyclic isocyanates which are solid at room temperature.

Examples of the isocyanate compounds are 2,6-dichlorophenyl isocyanate, p-chlorophenyl isocyanate, 1,3-phenylene diisocyanate, 1,3-dimethylbenzene 4,6-diisocyanate, 1,4-dimethylbenzene ·2,5-diisocyanate, 1-methoxybenzene 2,4-diisocyanate, 1-methoxybenzene 2,5-diisocyanate, 1-ethoxybenzene 2,4-diisocyanate, 2,5-dimethoxybenzene 1,4-diisocyanate, 2,5-diethoxybenzene 1,4-diisocyanate, 2,5-dimethoxybenzene 1,4-diisocyanate, azobenzene 4,4'-diisocyanate, diphenylether 4,4'-diisocyanate, naphthalene 1,4-diisocyanate, naphthalene 1,5-diisocyanate, naphthalene 1,6-diisocyanate, naphthalene 2,6-diisocyanate, naphthalene 2,7-diisocyanate, 3,3'-dimethyl-biphenyl 4,4'-diisocyanate, 3,3'-dimethoxybiphenyl 4,4'-diisocyanate, diphenylmethane 4,4'-diisocyanate, diphenyldimethylmethane 4,4'-diisocyanate, benzophenone 3,3'-diisocyanate, fluorene 2,7-diisocyanate, anthraquinone 2,6-diisocycnate, 9-ethylcarbazole 3,6-diisocyanate, pyrene 3,8-diisocyanate, naphthalene 1,3,7-triisocyanate, biphenyl 2,4,4'-triisocyanate, 4,4',4''-triisocyanate-2,5-dimethoxytriphenylamine, p-dimethylaminophenyl isocyanate, tris(4-phenyl isocyanate)thiophosphate, etc. These isocyanate compounds can be used alone or as a mixture thereof.

As the dye precursor (a), there can be used triphenylmethanes, fluorans, diphenylmethanes, thiazines, and spiropyrans.

Examples of the dye precursors are 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluoran, 3-diethylamino-7-chlorofluoran, 3-(N-cyclohexylamino)-7-methylfluoran, 3-diethylamino-7-methylfluoran, 3-diethylamino-6-chloro-7-methylfluoran, 3-diethylamino-7-anilinofluoran, 3-diethylamino-6-methyl-7-dibenzylaminofluoran, 3-(N-ethyl-N-p-toluidino)-7-anilinofluoran, 3-diethylamino-7-(O-chloroanilino)fluoran, 3-dibutylamino-7-(O-chloroanilino)fluoran, 3-diethylamino-6-methyl-7-anilinofluoran, 3-(N-ethyl-N-p-toluidino)-6-methyl-7-anilinofluoran, 3-(N-methyl-N-cyclohexylamino)-6-methyl-7-anilinofluoran, 3-piperidino-6-methyl-7-anilinofluoran, 3-pyrrolidino-6-methyl-7-anilinofluoran, 3-diethylamino-7-(m-trifluoromethylanilino)fluoran, 3-(N-ethyl-N-isopentylamino)-6-methyl-7-anilinofluoran, 3-diethylamino-6-methyl-7-(p-phenetidino)fluoran, 3-dibutylamino-7-(O-fluoroanilino)fluoran, etc. These dye precursors can be used alone or as a mixture thereof.

The isocyanate compound (b) is used in an amount of 0.1 to 10 parts by weight, preferably 0.25 to 5 parts by weight, more preferably 0.5 to 3 parts by weight per part by weight of the dye precursor (a). When the amount of the isocyanate compound is less than 0.1 part by weight, the color formation of the dye precursor becomes insufficient and the developed color density becomes low. On the other hand, when the amount of the isocyanate compound is more than 10 parts by weight, unreacted isocyanate compound remains uneconomically.

In the case of three-component color forming system comprising (a) a colorless or light-colored dye precursor, (b) an isocyanate compound having aromaticity, and (c) a color developer which can form a color by contacting with the dye precursor, a higher image density than the case of the two-component color forming system comprising (a) the dye precursor and (b) the isocyanate compound can be obtained in addition to higher image storability such as light resistance and plasticizer resistance, etc.

In the three-component color forming system, the isocyanate compound is used in an amount of 0.1 to 10 part by weight, preferably 0.25 to 5 parts by weight, more preferably 0.5 to 3 parts by weight, per part by weight of the dye precursor. When the amount of the isocyanate compound is less than 0.001 part by weight, sufficient image storability cannot be obtained. On the other hand, there is no upper limit of the amount of the isocyanate compound, but when the amount is more than 5 parts by weight, an economically unpreferable case often takes place. The color developer is used in an amount of 0.1 to 20 parts by weight, preferably 0.25 to 10 parts by weight, more preferably 0.5 to 5 parts by weight, per part by weight of the dye precursor.

As the color developer, there can be used acidic substances, that is, electron-accepting compounds conventionally used in this art. These electron-accepting compounds can be selected properly depending on kinds of recording materials, for example, pressure-sensitive recording materials, heat-sensitive recording materials, electric current-passing heat-sensitive recording materials, heat-transfer recording materials, static recording materials, laser recording materials, etc.

For example, in the case of heat-sensitive recording materials, phenol derivatives and aromatic carboxylic acid derivatives are mainly used as the color developer. Among phenol derivatives, those having at least one phenolic hydroxyl group are preferable, and those having no substituent at one or both of phenolic hydroxyl groups positioned at the ortho positions are more preferable.

Examples of the phenol derivatives are phenol, p-t-butylphenol, p-phenylphenol, 1-naphthol, 2-naphthol, p-hydroxyacetophenone, 2,2'-dihydroxybiphenyl, 4,4'-isopropylidenediphenol, 4,4'-isopropylidene diphenol, 4,4'-isopropylidenebis(2-t-butylphenol), 4,4'-isopropylidenebis(2-chlorophenol), 4,4'-cyclohexylidenediphenol, 2,2-bis(4-hydroxyphenyl)butane, 2,2-bis(4-hydroxyphenyl)pentane, 2,2-bis(4-hydroxyphenyl)hexane, methyl diphenolacetate, bis(4-hydroxyphenyl)sulfone, C bis(3-allyl-4-hydroxyphenyl)sulfone, 4-hydroxy-4'-methyldiphenylsulfone-4-hydroxy-4'-isopropyloxydiphenylsulfone, bis(4-hydroxyphenyl)sulfide, 4,4'-thiobis(2-t-butyl-5-methyl)phenol, 1,7-bis(4-hydroxyphenylthio)-3,5-dioxyheptane, novolac type phenol resins, etc.

Examples of the aromatic carboxylic acid derivatives are benzoic acid, p-t-butyl benzoate, p-hydroxybenzoic acid, methyl p-hydroxybenzoate, isopropyl p-hydroxybenzoate, benzyl p-hydroxybenzoate, lauryl gallate, stearyl gallate, salicylanilide, 5-chlorosalicylanilide, a metal (e.g. Zn) salt of 5-t-butyl salicylate, a metal (e.g. Zn) salt of hydroxynaphthoic acid, etc.

In the case of the pressure-sensitive recording materials, there can be used as the color developer inorganic compounds such as acid clay, active clay, attapulgite, bentonite, zeolite, colloidal silica, magnesium silicate, talc, aluminum silicate, etc.; phenol derivatives such as phenol, cresol, butylphenol, octylphenol, phenylphenol, chlorophenol, salicylic acid, and aldehyde condensed novolac resins derived from these compounds and metal salts thereof; salicylic acid derivatives such as 3-isopropyl salicylate, 3-phenyl salicylate, 3-cyclohexyl salicylate, 3,5-di-t-butyl salicylate, 3,5-di(α-methylbenzyl)salicylate, 3,5-di-t-octyl salicylate, 3-methyl-5-benzyl salicylate, 3,5-di(α,α-dimethylbenzyl)salicylate, 3-phenyl-5-(α,α-dimethylbenzyl)salicylate, etc. and metal salts thereof.

In the case of the light-sensitive recording materials, there can be used as the color developer compounds which produce hydrogen halides, carboxylic acids, sulfonic acids, phenols, etc., by light. Examples of these compounds are organic halogen compounds such as carbon tetrabromide, iodoform, trichloromethylsulfonylbenzene, etc.; o-quinoneazide derivatives; phenol esters of sulfonic acid, etc.

Recording materials using the two-component color-forming system comprising (a) the dye precursor and (b) the isocyanate compound having aromaticity, or the three-component color-forming system comprising (a) the dye precursor, (b) the isocyanate compound having aromaticity, and (c) the color developer, can be prepared as follows.

As disclosed in Japanese Patent Examined Publication Nos. 43-4160, 44-3680 and 45-14039, the color-forming components, that is, the dye precursor, the isocyanate compound, and if necessary the color developer, in dispersed state of very fine powder are coated on a support together with a binder to form a color-forming layer. The color-forming layer may be a single layer or a plurality of layers. The color-forming components may be contained in the same layer or in different layers. In the case of multi-layers, one or more intermediate layers may be interposed among individual layers. Further, a protective layer may be formed on a color-forming layer, or an undercoating layer may be previously formed on the support. The isocyanate compound having aromaticity is used in a dispersed form of very fine powder like other color-forming component(s) in neighbor thereof. The object of this invention can be attained even if the isocyanate compound is added to any color-forming layers.

The color-forming layer or layers may contain one or more pigments such as diatomaceous earth, talc, kaolin, calcined kaolin, calcium carbonate, magnesium carbonate, titanium oxide, zinc oxide, silicon oxide, aluminum hydroxide, urea-formaldehyde resin, etc.; metal salts of higher fatty acids such as zinc stearate, calcium stearate, etc. or waxes such as paraffins, oxidized paraffin wax, polyethylene, oxidized polyethylene, stearamide, castor wax, etc. for preventing wear of heads or sticking of heads; dispersing agents such as sodium dioctyl sulfosuccinate, etc.; ultraviolet absorbers such as benzophenones, benzotriazoles, etc.; surface active agents, fluorescent dyes, etc.

In the case of using as pressure-sensitive recording materials, there can be used techniques disclosed in U.S. Pat. Nos. 2,505,470; 2,712,507; 2,730,456; 2,730,457 and 3,418,250. For example, the dye precursor alone or admixed is dissolved in a solvent of synthetic oil such as alkylated naphthalene, alkylated diphenyl, alkylated diphenylmethane, alkylated diarylethane, chlorinated paraffin, or the like, or a vegetable oil, animal oil, or mineral oil, alone or as a mixture thereof. The resulting solution is dispersed in a binder and coated on a support, or the dispersion contained in microcapsules is coated on a support together with a binder, to prepare a top sheet. On the other hand, the isocyanate compound alone or mixed with the color developer is dispersed in a binder, and if necessary mixed with one or more pigments and the like additives, and coated on a support to prepare a bottom sheet. The coated surfaces of the top sheet and the bottom sheet are faced oppositely and used for recording images. It is also possible to use intermediate sheets obtained by coating the dispersion of the isocyanate compound on one side of a support and coating the dispersion containing the dye precursor on the other side of the support. In the case of self-contained type, the dispersion of the isocyanate compound and the dispersion of the dye precursor are coated on the same side of a support in admixture or multilayers. Various other conventional types of recording materials can also be applied to this invention.

Microcapsules can be produced by the coacervation method disclosed, for example, in U.S. Pat. Nos. 2,800,457 and 2,800,458; by the interfacial polymerization method disclosed, for example, in Japanese Patent Examined Publication Nos. 38-19574, 42-446, and 42-771; by the in-situ method disclosed, for example, in Japanese Patent Examined Publication No. 36-9168 and Japanese Patent Unexamined Publication No. 51-9079; by the melt dispersion cooling method disclosed, for example, in British Patent Nos. 952,807 and 965,074; by the spray drying method disclosed, for example, in U.S. Pat. No. 3,111,407 and British Patent No. 930,422.

According to the interfacial polymerization method, an oil-soluble monomer and a water-soluble monomer are used and a film is formed at the interface. For example, a polyamide film is formed at the interface by using a polybasic acid chloride in the oil phase and a polyvalent amine in the water phase; a polyester film is formed at the interface by using a polybasic acid chloride in the oil phase and a polyhydric hydroxy compound in the water phase; a polyurethane film is formed at the interface by using a polyvalent isocyanate in the oil phase and a polyhydric alcohol or phenol in the water phase; or a polyurea film is formed at the interface by using a polyvalent isocyanate in the oil phase and a polyvalent amine in the water phase.

As mentioned above, an isocyanate compound can be used as one reactive monomer for forming a film according to the interfacial polymerization method for producing microcapsules. But in this case, the isocyanate compound is consumed to form films of microcapsules, and not used as a color-forming component. Further, the use of the water-soluble monomer together with the isocyanate compound is essential. Therefore, the use of isocyanate compound in the microcapsule production technique is clearly distinguished from the use of the isocyanate compound as a color-forming component in this invention.

The electric current-passing heat-sensitive recording material can be prepared, for example, according to Japanese Patent Unexamined Publication No. 49-11344 and 50-48930. For example, an electroconducting agent such as copper iodide, zinc oxide, or the like, a dye precursor and an isocyanate compound having aromaticity, and if necessary a color developer, are dispersed together with a binder and coated on a support. Alternatively, an electroconducting agent is previously coated on a support or vapor deposited on a support to form an electroconducting layer, on which a dispersion of a dye precursor, an isocyanate compound having aromaticity, and if necessary a color developer, and a binder is coated on a support.

As the support used in the recording material of this invention, there can be used paper, various kinds of non-woven fabrics, synthetic resin films, laminate paper, synthetic paper, metal foils, etc. It is possible to use a composite sheet obtained by combining these support materials depending on purposes.

As the binder, there can be used water-soluble binders such as starchs, hydroxyethyl cellulose, methyl cellulose, carboxymethyl cellulose, gelatin, casein, polyvinyl alcohol, modified polyvinyl alcohol, styrenemaleic anhydride copolymer, ethylene-maleic anhydride copolymer, etc.; latex type water-insoluble binders such as styrene-butadiene copolymer, acrylonitrile-butadiene copolymer, methyl acrylate-butadiene copolymer, etc.

This invention is explained in detail referring to Examples, in which all parts and percents are by weight unless otherwise specified.

EXAMPLE 1

3-(N-Ethyl-N-isopentylamino)-6-methyl-7-anilinofluoran in an amount of 10 g and 30 g of a 2% aqueous solution of polyvinyl alcohol were ball milled for 24 hours to give a dispersion. On the other hand, 10 g of 4,4',4''-triisocyanate-2,5-dimethoxyphenylamine and 30 g of a 2% aqueous polyvinyl alcohol were balled milled for 24 hours to give a dispersion. After mixing the resulting dispersions, 100 g of a 40% dispersion of calcium carbonate, 25 g of a 20% dispersion of zinc stearate, 25 g of a 20% dispersion of stearamide and 140 g of a 10% aqueous solution of polyvinyl alcohol were added to the resulting mixture and stirred sufficiently to give a coating liquid.

The coating liquid was coated on a base sheet having a basis weight of 55 g/m$^2$ so as to make the coating amount 7.0 g/m$^2$ in solids content using a Mayer bar and dried, followed by treatment with a super calender to provide a heat-sensitive recording material.

EXAMPLE 2

The process of Example 1 was repeated except for using 4,4',4''-triisocyanate-triphenylamine in place of 4,4',4''-triisocyanate-2,5-dimethoxytriphenylamine to provide a heat-sensitive recording material.

EXAMPLE 3

The process of Example 1 was repeated except for using 3,6-diisocyanate-N-ethylcarbazole in place of 4,4',4''-isocyanate-2,5-dimethoxytriphenylamine to provide a heat-sensitive recording material.

EXAMPLE 4

The process of Example 1 was repeated except for using 1,4-diisocyanate-2,5-diethoxybenzene in place of 4,4',4''-triisocyanate-2,5-dimethoxytriphenylamine to provide a heat-sensitive recording material.

COMPARATIVE EXAMPLE 1

The process of Example 1 was repeated except for using 2,2-bis(p-hydroxyphenyl)propane in place of 4,4',4''-triisocyanate-2,5-dimethoxytriphenylamine to provide a heat-sensitive recording material.

COMPARATIVE EXAMPLE 2

4,4',4''-Triisocyanate-2,5-dimethoxytriphenylamine in an amount of 10 g and 30 g of a 2% aqueous solution of polyvinyl alcohol were ball milled for 24 hours for dispersing. On the other hand, 10 g of 1,3-diimino-4,5,6,7-tetrachloroindoline and 30 g of 2% aqueous solution of polyvinyl alcohol were ball milled for 24 hours for dispersing. After mixing the resulting dispersions, 100 g of a 40% dispersion of calcium carbonate, 25 g of a 20% dispersion of zinc stearate, 25 g of a 20% dispersion of stearamide and 140 g of a 10% aqueous solution of polyvinyl alcohol were added to the resulting mixture and stirred sufficiently to give a coating liquid.

A heat-sensitive recording material was obtained in the same manner as described in Example 1.

EVALUATION 1

The heat-sensitive recording materials obtained in Examples 1 to 4 and Comparative Examples 1 and 2 were subjected to printing using a heat-sensitive paper printing tester (mfd. by Matsushita Denshi Buhin K.K.) under conditions of applied pulse of 3.0 millisec. and applied voltage of 16.00 volts. The density of obtained colored images was measured by using a Macbeth densitometer RD918 and shown in Table 1.

EVALUATION 2

The colored image obtained in Evaluation 1 was exposed to sunbeams inside a window glass at south side for 12 days. The densities before and after the test were measured in the same manner as described in Evaluation 1. The image retention rate in terms of light resistance was obtained by the following equation and shown in Table 1.

$$\text{Image retention rate} = \frac{\text{Density after exposure to sunbeams}}{\text{Density before exposure to sunbeams}} \times 100\%$$

EVALUATION 3-1

A mending tape (Scotch 810, a trade name, mfd. by Minnesota Mining and Manufacturing Co.) was adhered to the colored image portion obtained in Evaluation 1 and stored at room temperature for 7 days. The densities before and after the test were measured in the same manner as described in Evaluation 1. The image retention rate in terms of plasticizer resistance was obtained by the following equation and shown in Table 1.

$$\text{Image retention rate} = \frac{\text{Density after adhering mending tape}}{\text{Density before adhering Mending tape}} \times 100(\%)$$

EVALUATION 3-2

The densities of initial textures of the heat-sensitive recording materials obtained in Examples 1 to 4 and Comparative Examples 1 and 2 were measured by using the Macbeth densitometer RD918. A mending tape was adhered to a texture portion in the same manner as described in Evaluation 3-1 and the density of color at the texture portion with the lapse of time (texture density after contacted with plasticizer) was measured by using the Macbeth densitometer RD918. The results are shown in Table 1.

TABLE 1

| | Evaluation 1 Developed color density | Evaluation 2 Image retention rate in terms of light resistance (%) | Evaluation 3-1 Image retention rate in terms of plasticizer resistance (%) | Evaluation 3-2 Initial density of texture | Evaluation 3-2 Texture density after contacted with plasticizer |
|---|---|---|---|---|---|
| Example 1 | 1.02 | 98.0 | 102.9 | 0.07 | 0.15 |
| Example 2 | 0.97 | 97.9 | 101.1 | 0.05 | 0.14 |
| Example 3 | 1.04 | 96.2 | 98.1 | 0.06 | 0.16 |
| Example 4 | 1.10 | 98.2 | 101.8 | 0.08 | 0.18 |
| Comparative Example 1 | 1.19 | 72.5 | 21.5 | 0.06 | 0.05 |
| Comparative Example 2 | 0.72 | 87.6 | 116.6 | 0.06 | 0.37 |

Note:
① In Evaluation 3-1, the image retention rate of more than 100% means that the developed color density increases with the lapse of time.
② In Evaluation 3-2, the texture density with the lapse of time being higher than the initial value means that the plasticizer in the mending tape influences the texture density.

As is clear from Table 1, the image retention rates in terms of both light resistance and plasticizer resistance are high in Examples 1 to 4. In Comparative Example 1, the developed color density is high, but the image retention rate in terms of light resistance is low and particularly the image retention rate in terms of plasticizer resistance is extremely as low as 21.5%. In Comparative Example 2 wherein the imino compound and isocyanate compound are used as the color forming system, the developed color density is low and there is an undesirable tendency to develop a color from the initial texture density with the lapse of time when contacted with the plasticizer as shown in Evaluation 3-2.

EXAMPLE 5

3-(N-Ethyl-N-isopentylamino)-6-methyl-7-anilinofluoran in an amount of 10 g and 30 g of a 2% aqueous solution of polyvinyl alcohol were ball milled for 24 hours to give a dispersion. On the other hand, 25 g of 2,2-bis(p-hydroxyphenyl)propane and 75 g of a 2% aqueous solution of polyvinyl alcohol were balled milled for 24 hours to give a second dispersion. A third dispersion was prepared by ball milling 10 g of 4,4',4''-triisocyanate-2,5-dimethoxytriphenylamine and 30 g of a 2% aqueous solution of polyvinyl alcohol for 24 hours. After mixing three dispersions, 80 g of a 50% dispersion of calcium carbonate, 25 g of a 20% dispersion of zinc stearate, and 200 g of a 10% aqueous solution of polyvinyl alcohol were added thereto and stirred sufficiently to give a coating liquid.

A heat-sensitive recording material was obtained by coating the coating liquid on a base sheet having a basis weight of 55 g/m$^2$ so as to make the coating amount 5.0 g/m$^2$ in solids content, and dried, followed by treatment with a super calender.

EXAMPLE 6

The process of Example 5 was repeated except for using 4,4',4''-triisocyanate-triphenylamine in place of 4,4',4''-triisocyanate-2,5-dimethoxytriphenylamine to give a heat-sensitive recording material.

EXAMPLE 7

The process of Example 5 was repeated except for using 3,6-diisocyanate-N-ethylcarbazole in place of 4,4',4''-isocyanate-2,5-dimethoxytriphenylamine to give a heat-sensitive recording material.

EXAMPLE 8

The process of Example 5 was repeated except for using 1,4-diisocyanate-2,5-diethoxybenzene in place of 4,4',4''-triisocyante-2,5-dimethoxytriphenylamine to give a heat-sensitive recording material.

EXAMPLE 9

The process of Example 5 was repeated except for using benzyl 4-hydroxybenzoate in place of 2,2-bis(p-hydroxyphenyl)propane to give a heat-sensitive recording material.

COMPARATIVE EXAMPLE 3

The process of Example 5 was repeated except for not using 4,4',4''-triisocyanate-2,5-dimethoxytriphenylamine to give a heat-sensitive recording material.

COMPARATIVE EXAMPLE 4

The process of Example 9 was repeated except for not using 4,4',4''-triisocyanate-2,5-dimethoxytriphenylamine to give a heat-sensitive recording material.

Using the heat-sensitive recording materials obtained in Examples 5 to 9 and Comparative Examples 3 and 4, evaluations were made using Evaluations 1 and 2 mentioned above. The results are shown in Table 2.

TABLE 2

| | Evaluation 1 Developed color density | Evaluation 2 Image retention rate (%) |
|---|---|---|
| Example 5 | 1.14 | 97.3 |
| Example 6 | 1.10 | 98.2 |
| Example 7 | 1.15 | 95.8 |
| Example 8 | 1.20 | 91.6 |
| Example 9 | 1.09 | 89.1 |
| Comparative Example 3 | 1.19 | 72.5 |
| Comparative Example 4 | 1.13 | 36.1 |

As is clear from Table 2, the image retention rates are high in Examples 5 to 9. On the other hand, in Comparative Examples 3 and 4, although the developed color densities are the same as those of Examples 5 to 9, the image retention rates are low.

EXAMPLE 10

(1) Production of Top Sheet

In 100 parts of a 5% aqueous solution of pH 4.0 obtained by dissolving styrene-maleic anhydride copolymer and a small amount of sodium hydroxide, 80 parts of an oil Nisseki Hisol N-296 (a trade name mfd. by Nippon Petrochemicals Co., Ltd.) dissolving 2.5 parts of 3-diethylamino-7-chlorofluofluoran was emulsified. A melamine-formaldehyde precondensate was prepared by mixing 10 parts of melamine, 25 parts of a 37% formalin solution and 65 parts of water, making the pH of the mixture 9.0 with sodium hydroxide, and heating the mixture at 60° C. for 15 minutes to make transparent. The precondensate was added to the above-mentioned emulsion and stirred for 4 hours while maintaining at 60° C., followed by cooling to room temperature. The resulting microcapsule dispersion had a solids content of 45%.

A top sheet was produced by coating the thus obtained microcapsule dispersion on paper and dried.

(2) Production of Bottom Sheet 4,4',4''-Triisocyanate-2,5-dimethoxytriphenylamine in an amount of 10 g and 30 g of a 2% aqueous solution of polyvinyl alcohol were ball milled for 24 hours to give a dispersion. To this dispersion, 125 g of a 40% dispersion of calcium carbonate and 120 g of a 10% polyvinyl alcohol aqueous solution were added and stirred sufficiently. The resulting coating liquid was coated on a base sheet having a basis weight of 40 g/m$^2$ using a mayer bar to give a bottom sheet.

EVALUATION 4

The top sheet and the bottom sheet obtained in Example 10 were laminated so as to face the coated sides oppositely and pressed to give a colored image on the bottom sheet. For comparison, using a commercially available bottom sheet not treated with the isocyanate compound having aromaticity, a colored image was obtained as mentioned about. Densities of individual colored images were measured by using the Macbeth densitometer RD918. The results are shown in Table 3.

EVALUATION 5

The colored image obtained in Evaluation 4 was exposed to sunbeams inside a window glass at south side for 2 days. The image retention rate in terms of light resistance was obtained in the same manner as described in Evaluation 2. The results are shown in Table 3.

EVALUATION 6

A mending tape (Scotch 810, a trade name, mfd. by Minnesota Mining and Manufacturing Co.) was adhered to the colored image portion obtained in Evaluation 4 and stored at room temperature for 7 days. The densities before and after the test were measured in the same manner as described in Evaluation 4 to obtain the image retention rate in terms of plasticizer resistance. The results are shown in Table 3.

TABLE 3

| | Evaluation 4 Developed color density | Evaluation 5 Image retention rate in terms of light resistance (%) | Evaluation 6* Image retention rate in terms of light resistance (%) |
|---|---|---|---|
| Example 10 | 0.57 | 96.5 | 107.0 |
| Comparision | 0.61 | 87.0 | 40.5 |

Note:
*In Evaluation 6. the image retention rate of more than 100% means that the developed color image increases with the lapse of time.

As is clear from Table 3, the image retention rates in terms of both light resistance and plasticizer resistance are high in Example 10. On the other hand, in comparison, the image retention rate is low and that in terms of plasticizer resistance is extremely low.

EXAMPLE 11

(1) Production of Top Sheet

A top sheet was produced in the same manner as described in Example 10 (1).

(2) Production of Bottom Sheet 4,4',4''-Triisocyanate-2,5-dimethoxytriphenylamine in an amount of 10 g and 30 g of a 2% aqueous solution of polyvinyl alcohol were balled milled for 24 hours to prepare a dispersion. The resulting dispersion was coated on a bottom sheet commercially available for common pressure-sensitive paper, and dried to give a bottom sheet.

Using the top sheet and the bottom sheet, Evaluations 4 and 5 were carried out.

For comparison, a bottom sheet commercially available and not treated with the isocyanate compound having aromaticity was used and evaluated in the same manner as mentioned above. The results are shown in Table 4.

TABLE 4

| | Evaluation 4 | Evaluation 5 | |
|---|---|---|---|
| | Developed color density | Image retention rate (%) | Hue |
| Example 11 | 0.66 | 100 | Black color was maintained without change. |
| Comparison | 0.61 | 87 | Changed to red. |

As is clear from Table 4, the image retention rate is 100% (without any change) and the hue is not changed. In contrast, in comparison, the image retention rate is decreased to 87% and the hue is changed from black to red.

The fundamental two-component color forming system used in the recording material of this invention is clearly different from known two-component color forming system comprising a dye precursor and a color developer, or an imino compound and an isocyanate compound having aromaticity, and is superior to the known two-component color forming system in the image retention rates in terms of light resistance and plasticizer resistance, causes no hue change when exposed to light and has a large degree of freedom for hues. Thus, the recording material of this invention is remarkably useful industrially.

What is claimed is:

1. A recording material consisting essentially of a two-component color forming system comprising:

(a) a colorless or light colored dye precursor which is at least one member selected from the group consisting of triphenylmethanes, fluorans, diphenylmethanes, thiazines and spiropyrans, and (b) an isocyanate compound having aromaticity, said color forming system being carried on a substrate.

2. A recording material according to claim 1, wherein the isocyanate compound is at least one member selected from the group consisting of aromatic isocyanates and heterocyclic isocyanates.

3. A recording material according to claim 1, wherein the amount of the isocyanate compound is 0.1 to 10 parts by weight per part by weight of the dye precursor.

4. A recording material consisting essentially of a two-component color forming system comprising:

(a) a colorless or light-colored dye precursor which is at least one member selected from the group consisting of triphenylmethanes, fluorans, diphenylmethanes, thiazines and spriopyrans, and (b) an isocyanate compound having aromaticity, said color forming system being carried on at least two different substrates separately depending on individual components.

5. A recording material according to claim 4, wherein the isocyanate compound is at least one member selected from the group consisting of aromatic isocyanates and heterocyclic isocyanates.

6. A recording material according to claim 4, wherein the amount of the isocyanate compound is 0.1 to 10 parts by weight per part by weight of the dye precursor.

7. A recording material consisting essentially of a three-component forming system comprising:

(a) a colorless or light-colored dye precursor which is at least one member selected from the group consisting of triphenylmethanes, fluorans, diphenylmethanes, thiazines and spiropyrans, (b) an isocyanate compound having aromaticity, and (c) a color developer which can form a color by contacting with the dye precursor, said color forming system being carried on a substrate.

8. A recording material according to claim 7 wherein the component (c) is an acidic substance.

9. A recording material according to claim 7 wherein the component (c) is a phenol derivative or an aromatic carboxylic acid derivative.

10. A recording material according to claim 7 wherein the component (c) is an organic compound, a phenol derivative, an aldehyde condensed novolac resin or a metal salt thereof, a salicylic acid derivative or a metal salt thereof.

11. A recording material according to claim 7 wherein the component (c) is a compound which produces a hydrogen halide, carboxylic acid, sulfonic acid or a phenol, by light.

12. A recording material consisting essentially of a three-component color forming system comprising (a) a colorless or light-colored dye precursor which is at least one member selected from the group consisting of triphenylmethanes, fluorans, diphenylmethanes, thiazines and spriopyrans, (b) an isocyanate compound having aromaticity, and (c) a color developer which can form a color by contacting with the dye precursor, said color forming system being carried on at least two substrates separately depending on individual components.

13. A recording material according to claim 12 wherein the component (c) is an acidic substance.

14. A recording material according to claim 12 wherein the component (c) is a phenol derivative or an aromatic carboxylic acid derivative.

15. A recording material according to claim 12 wherein the component (c) is an organic compound, a phenol derivative, an aldehyde condensed novolac resin or a metal salt thereof, a salicylic acid derivative or a metal salt thereof.

16. A recording material according to claim 12 wherein the component (c) is a compound which produces a hydrogen halide, carboxylic acid, sulfonic acid or a phenol, by light.

17. A recording material consisting essentially of a two-component color forming system comprising:

(a) a colorless or light colored dye precursor wherein the dye precursor is one or more compounds selected from 3,3-bis-(p-dimethylaminophenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluoran, 3-diethylamino-7-chlorofluoran, 3-(N-cyclohexyl-amino)-7-methylfluoran, 3-diethylamino-7-methylfluoran, 3-diethylamino-6-chloro-7-methylfluoran, 3-diethylamino-7-anilinofluoran, 3-diethylamino-6-methyl-7-dibenzylaminofluoran, 3-(N-ethyl-N-p-toluidino)-7-anilinofluoran, 3-diethylamino-7-(O-chloroanilino)fluoran, 3dibutyl-amino-7-(O-chloroanilino)fluoran, 3-diethylamino-6-methyl-7-anilinofluoran, 3-(N-ethyl-N-p-toluidino)-6-methyl-7-anilinofluoran, 3-(N-methyl-N-cyclohexylamino)-6-methyl-7-anilinofluoran, 3-piperidino-6-methyl-7-anilinofluoran, 3pyrrolidino-6-methyl-7-anilinofluoran, 3-diethylamino-7-(m-trifluoromethylanilino)fluoran, 3-(N-ethyl-N-isopentylamino)-6-methyl-7-anilinofluoran, 3-diethylamino-6-methyl-7-(p-phenetidino)fluoran, and 3-dibutylamino-7-(O-fluoroanilino)fluoran, and (b) an isocyanate compound having aromaticity, said color forming system being carried on a substrate.

18. A recording material consisting essentially of a two-component color forming system comprising:

(a) a colorless or light-colored dye precursor wherein the dye precursor is one or more compounds selected from 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluoran, 3-diethylamino-7-chlorofluoran, 3-(N-cyclohexylamino)-7-methylfluoran, 3-diethylamino-7methylfluoran, 3-diethylamino-6-chloro-7-methylfluoran, 3-diethylamino-7-anilinofluoran, 3-diethylamino-6-methyl-7-dibenzylaminofluoran, 3-(N-ethyl-N-p-toluidino)-7-anilinofluoran, 3-diethylamino-7-(O-chloroanilino)fluoran, 3-dibutylamino-7-(O-chloroanilino)fluoran, 3-diethylamino-6-methyl-7-anilinofluoran, 3-(N-ethyl-N-p-toluidino)-6-methyl-7-anilinofluoran, 3-(N-methyl-N-cyclohexylamino)-6-methyl-7-anilinofluoran, 3-piperidino-6-methyl-7-anilinofluoran, 3-pyrrolidino-6-methyl-7-anilinofluoran, 3-diethylamino-7-(m-trifluoromethylanilino)fluoran, 3-(N-ethyl-N-isopentylamino)-6-methyl-7-anilinofluoran, 3-diethylamino-6-methyl-7-(p-phenetidino)fluoran, and 3-dibutylamino-7-(O-fluoroanilino)fluoran, and (b) an isocyanate compound having aromaticity, said color forming system being carried on at least two different substrates separately depending on individual components.

* * * * *